US008706506B2

(12) United States Patent
Okazaki

(10) Patent No.: US 8,706,506 B2
(45) Date of Patent: Apr. 22, 2014

(54) WAVEFORM COMPRESSING APPARATUS, WAVEFORM DECOMPRESSING APPARATUS, AND METHOD OF PRODUCING COMPRESSED DATA

(75) Inventor: Masatsugu Okazaki, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 1467 days.

(21) Appl. No.: 11/965,539

(22) Filed: Dec. 27, 2007

(65) Prior Publication Data

US 2008/0167882 A1 Jul. 10, 2008

(30) Foreign Application Priority Data

Jan. 6, 2007 (JP) ..... 2007-000874

(51) Int. Cl.
*G10L 19/00* (2013.01)
*G10L 21/00* (2013.01)

(52) U.S. Cl.
USPC ..... 704/500; 704/219; 704/230; 84/600; 84/603; 84/604; 700/94

(58) Field of Classification Search
USPC ..... 704/500–503, 222, 219, 230; 84/600–604; 700/94
See application file for complete search history.

(56) References Cited

U.S. PATENT DOCUMENTS 4,969,192 A * 11/1990 Chen et al. ..... 704/222
5,532,424 A * 7/1996 Hideo ..... 84/607
5,693,901 A * 12/1997 Matsunaga ..... 84/603
5,778,335 A 7/1998 Ubale et al.
5,797,121 A * 8/1998 Fette et al. ..... 704/230

(Continued)

FOREIGN PATENT DOCUMENTS

EP 1587062 10/2005
JP 01-187598 A 7/1989

(Continued)

OTHER PUBLICATIONS

Das, A. et al. (1999). "Multimode Variable Bit Rate Speech Coding: An Efficient Paradigm for High-Quality Low-Rate Representation of Speech Signal," *IEEE* pp. 2307-2310.

(Continued)

*Primary Examiner* — Shaun Roberts
(74) *Attorney, Agent, or Firm* — Morrison & Foerster LLP

(57) ABSTRACT

In a waveform compressing apparatus, a trial mode selecting portion selects a trial mode having the highest compression rate from a plurality of candidate modes which have not been selected before as a trial mode for generating a residue code, the selected trial mode comprising a scalar quantization mode or a vector quantization mode. A waveform data compressing portion compresses a given data amount of original waveform data according to the selected trial mode so as to generate the residue code, the data amount being determined in correspondence with the selected trial mode. A waveform data restoring portion generates a restored waveform data from the compressed data using the generated residue code. A determining portion measures an evaluation value of a quantization error contained in the restored waveform data relative to the original waveform data, and determines whether the evaluation value is equal to or smaller than a predetermined allowable value. A mode change instructing portion outputs a mode change instruction for instructing the trial mode selecting portion to select another trial mode when the evaluation value is not smaller than the predetermined allowable value.

10 Claims, 7 Drawing Sheets

(56) References Cited

U.S. PATENT DOCUMENTS

| | | | | | |
|---|---|---|---|---|---|
| 5,826,221 | A | * | 10/1998 | Aoyagi | 704/200 |
| 5,886,276 | A | | 3/1999 | Levine et al. | |
| 5,920,853 | A | * | 7/1999 | Benyassine et al. | 1/1 |
| 6,034,632 | A | * | 3/2000 | Matsumoto et al. | 341/200 |
| 6,064,954 | A | * | 5/2000 | Cohen et al. | 704/207 |
| 6,122,608 | A | * | 9/2000 | McCree | 704/219 |
| 6,510,407 | B1 | * | 1/2003 | Wang | 704/207 |
| 6,816,833 | B1 | * | 11/2004 | Iwamoto et al. | 704/207 |
| 8,090,573 | B2 | * | 1/2012 | Manjunath et al. | 704/201 |

FOREIGN PATENT DOCUMENTS

| | | | |
|---|---|---|---|
| JP | 2004-294491 | | 10/2004 |
| JP | 2005-189886 | A | 7/2005 |
| WO | WO-00/30075 | A1 | 5/2000 |

OTHER PUBLICATIONS

Decision to Refuse a European Patent Application mailed Mar. 23, 2010, for EP Patent Application No. 08100017.6, 45 pages.

EP Office Action mailed Feb. 13, 2009, for EP Patent Application No. 08100017.6, two pages.

EP Office Action mailed Jul. 3, 2009, for EP Patent Application No. 08100017.6, three pages.

EP Summons to Attend Oral Proceedings mailed Dec. 12, 2009, for EP Patent Application No. 08100017.6, four pages.

European Search Report mailed Apr. 4, 2008, for EP Application No. 08100017.6, six pages.

Notification of Reasons for Rejection mailed Oct. 25, 2011, for JP Patent Application No. 2007-000874, with English Translation, 10 pages.

Kamimura, N. (Jul. 15, 1981). "Speech Coding by Vector Quantization," *Information Processing, Corporation of Information Processing Society of Japan*, 22(7):702-703, with English Translation, five pages.

Notification of Reasons for Rejection mailed Feb. 28, 2012, for JP Patent Application No. 2007-000874, with English Translation, 10 pages.

* cited by examiner

WAVEFORM COMPRESSING APPARATUS, WAVEFORM DECOMPRESSING APPARATUS, AND METHOD OF PRODUCING COMPRESSED DATA

BACKGROUND OF THE INVENTION

1. Technical Field

The present invention relates to a waveform compressing apparatus for compressing a waveform data, a waveform decompressing apparatus for decompressing a compressed data, and a method of producing a compressed data.

2. Background Art

In case that a waveform data is recorded to a waveform memory used in an electronic musical instrument or the like, there is known a technology of reducing a capacity of the waveform memory by compressing the waveform data. As systems of compressing the waveform data, there are known a scalar quantizing system and a vector quantizing system. According to the scalar quantizing system, "1" sample of an instantaneous value of the waveform data is made to correspond to "1 code" of the compressed data, and according to the vector quantizing system, a plurality of samples of instantaneous values of the waveform data are made to correspond to "1 code" of the compressed data.

In a waveform memory sound source of a background art, an adopted quantizing system is the scalar quantizing system, and the vector quantizing system is not adopted. This is because the waveform data of musical instrument sound changes over time in a characteristic of the waveform, and therefore, it is difficult to find out a characteristic common to a total of the waveform data (correlation among instantaneous values). Thus, even if the vector quantizing system is adopted, it is difficult to achieve an advantage of promoting a compression rate. For example, JP-A-2004-294491 discloses a waveform memory sound source which subjects a waveform data to linearly predicted compression in a unit of a frame by a waveform compressing apparatus to thereby provide a compressed waveform data of a scalar quantizing system, and which stores the compressed waveform data to the waveform memory.

Meanwhile, by compressing the waveform data used in the waveform memory sound source, an economic effect achieved by promoting the compression rate is very remarkable. That is, copies of ROM recording the waveform data are mass-produced for the waveform memory sound source apparatuses, and therefore, when data amount of respective waveform data can be reduced even by small amounts, a significant economic effect is achieved as a whole.

On the other hand, in compressing the waveform data for a sound source apparatus, there is no need for real time performance. That is, when the waveform data for a sound source is compressed, even if a compressing process is carried out by consuming a time period exceeding a time length of the original waveform data, any problem is not particularly brought about.

In view of such a situation, when the waveform data for the sound source is compressed, even if a long time period is consumed, it is preferable to search a compression mode capable of reducing a data amount significantly.

Further, when musical instrument sound recorded as a waveform data for a sound source apparatus is observed, there is a tendency that at an attack portion where the waveform is disturbed, a correlation among sample values is reduced, and that at a steady-state portion where the waveform is stabilized, the correlation among the sample values is increased. Further, the tendencies significantly differ by a kind of a musical instrument. Therefore, when musical instrument sound is compressed to record by a unit of a frame, it is preferable not to apply fixedly a certain quantizing system or compressing mode but to adopt an optimum quantizing system for each frame. Further, when the vector quantizing system is adopted, it is conceived to be further preferable to apply an optimum one of a code book or the like for each frame.

SUMMARY OF THE INVENTION

The invention has been carried out in view of the above-described situation and it is an object of the invention to provide a waveform compressing apparatus capable of compressing a waveform data while selecting an optimum quantizing system and other condition at respective portions of the waveform data, as well as a waveform decompressing apparatus, and a method of producing a compressed data.

In a first aspect of the invention, a waveform compressing apparatus is designed for converting an original waveform data into a compressed data with a given compression rate, the compressed data having a plurality of frames of a predetermined format, each frame containing a residue code and sub information specifying a mode applied to generation of the residue code, the waveform compressing apparatus comprising: a trial mode selecting device that selects a trial mode having the highest compression rate from a plurality of candidate modes that have not been previously selected as a trial mode for generating the residue code; a waveform data compressing device that compresses a portion of the original waveform data according to the selected trial mode so as to generate the residue code corresponding to the selected trial mode, the portion amount being specified by the selected trial mode; a waveform data restoring device that restores a generated waveform data from the compressed data using the generated residue code; a determining device that determines an evaluation value that indicates a quantization error contained in the restored waveform data relative to the original waveform data, and that determines whether the evaluation value is equal to or smaller than a predetermined allowable value; a mode change instructing device that outputs a mode change instruction for instructing the trial mode selecting device to select another trial mode when the determining device determines that the evaluation value is not equal to or smaller than the predetermined allowable value; and a frame storing device that stores the generated residue code and the sub information specifying the selected trail mode in the frame when the determining device determines that the evaluation value is equal to or smaller than the predetermined allowable value.

Preferably, the plurality of the candidate modes include a vector quantization mode using a vector quantization method for generating the residue code.

Preferably, the plurality of the candidate modes include a group of scalar quantization modes using a scalar quantization method for generating the residue code and another group of vector quantization modes using a vector quantization method for generating the residue code, the respective scalar vector quantization modes generating the corresponding residue codes composed of bit numbers which are different from each other, and the respective vector quantization modes generating the corresponding residue codes composed of bit numbers which are different from each other.

In a second aspect of the invention, a waveform compressing apparatus is constructed for converting an original waveform data into a compressed data having a plurality of frames of a predetermined format, each frame containing a residue code and sub information specifying a mode applied to generation of the residue code, the waveform compressing apparatus comprising: a mode selecting device that selects one mode that is applied to generation of the residue code from a plurality of candidate modes, wherein said plurality of candidate modes are vector quantization modes using a vector quantization method in generating the residue code; a waveform data compressing device that generates the residue code in accordance with the selected mode by compressing a portion of the original waveform data, the portion amount being determined in correspondence with the selected mode; and a frame storing device that stores the generated residue code and sub information specifying the selected mode to the frame.

Preferably, the waveform compressing apparatus further comprises a code book selecting device that selects one code book from a plurality of code books that correspond to the selected mode, wherein the waveform data compressing device generates the residue code in accordance with the selected mode and the selected code book by compressing the portion of the original waveform data, and wherein the frame storing device stores the sub information containing information specifying the selected code book.

In a third aspect of the invention, a waveform decompressing apparatus is constructed for providing a restored waveform data composed of a sequence of waveform samples by decompressing a compressed data having a plurality of frames of a predetermined format, each frame containing a residue code and sub information specifying a mode applied to generation of the residue code, the waveform decompressing apparatus comprising: a mode determining device that determines whether the mode specified by the sub information is a vector quantization mode that uses a vector quantization method for generating the residue code; and an inverse quantization device that restores a plurality of waveform samples from one residue code contained in the frame when the mode determining device determines that the mode specified by the sub information is the vector quantization mode, and otherwise restores one waveform sample from one residue code contained in the frame when the mode determining device determines that the mode specified by the sub information is not the vector quantization mode.

In a fourth aspect of the invention, a waveform decompressing apparatus is designed for providing a restored waveform data composed of a sequences of waveform samples by decompressing a compressed data having a plurality of frames of a predetermined format, each frame containing a residue code and sub information specifying a mode applied to generation of the residue code, the waveform decompressing apparatus comprising: a mode specifying device that specifies a mode by reading the sub information for each frame, the specified mode being a vector quantization mode using a vector quantization method for generating the residue code; and an inverse quantization device that restores a plurality of waveform samples from each residue code contained in each frame based on the specified mode.

In a fifth aspect of the invention, a method is designed for producing a compressed data with a given compression rate based on an original waveform data, the compressed data having a plurality of frames of a predetermined format, each frame containing a residue code and sub information specifying a mode applied to generation of the residue code, the method comprising: a trial mode selecting process of selecting a trial mode having the highest compression rate from a plurality of candidate modes that have not been previously selected as a trial mode for generating the residue code; a waveform data compressing process of compressing a portion of the original waveform data according to the selected trial mode so as to generate the residue code corresponding to the selected trial mode, the portion amount being specified by the selected trial mode; a waveform data restoring process of restoring a generated waveform data from the compressed data using the generated residue code; a determining process of determining an evaluation value that indicates a quantization error contained in the restored waveform data relative to the original waveform data, and determining whether the evaluation value is equal to or smaller than a predetermined allowable value; a mode change instructing process of outputting a mode change instruction for instructing the trial mode selecting process to select another trial mode when the determining process determines that the evaluation value is not equal to or smaller than the predetermined allowable value; and a frame storing process of storing the generated residue code and the sub information specifying the selected trail mode in the frame when the determining process determines that the evaluation value is equal to or smaller than the predetermined allowable value.

In a sixth aspect of the invention, a method is designed for producing a compressed data having a plurality of frames of a predetermined format based on an original waveform data, each frame containing a residue code and sub information specifying a mode applied to generation of the residue code, the method comprising: a mode selecting process of selecting one mode that is applied to generation of the residue code from a plurality of candidate modes, wherein said plurality of candidate modes are vector quantization modes using a vector quantization method in generating the residue code; a waveform data compressing process of generating the residue code in accordance with the selected mode by compressing a portion of the original waveform data, the portion amount being determined in correspondence with the selected mode; and a frame storing process of storing the residue code and sub information specifying the selected mode to the frame.

In the constitution of selecting the trial mode in an order of a higher compression rate from the plurality of candidate modes, when the evaluation value of the quantization error becomes equal to or smaller than the allowable value, the waveform data can be compressed while selecting the optimum quantization system individually in the respective frames.

Further, according to the constitution having the scalar quantization method and the vector quantization method as the candidate modes, the optimum mode of the scalar quantization method or the vector quantization method can be selected at respective portions of the waveform data.

Further, according to the constitution of selecting the one mode for each frame from the plurality of candidate modes of the vector quantization method, the mode adapted to the respective characteristics of respective frames can be selected for respective frames, and therefore, the high compression rate can be realized by utilizing advantages of the vector quantization method.

DETAILED DESCRIPTION OF THE INVENTION

1. Musical Sound Generating Apparatus 1.1 Total Constitution

Figure 1:
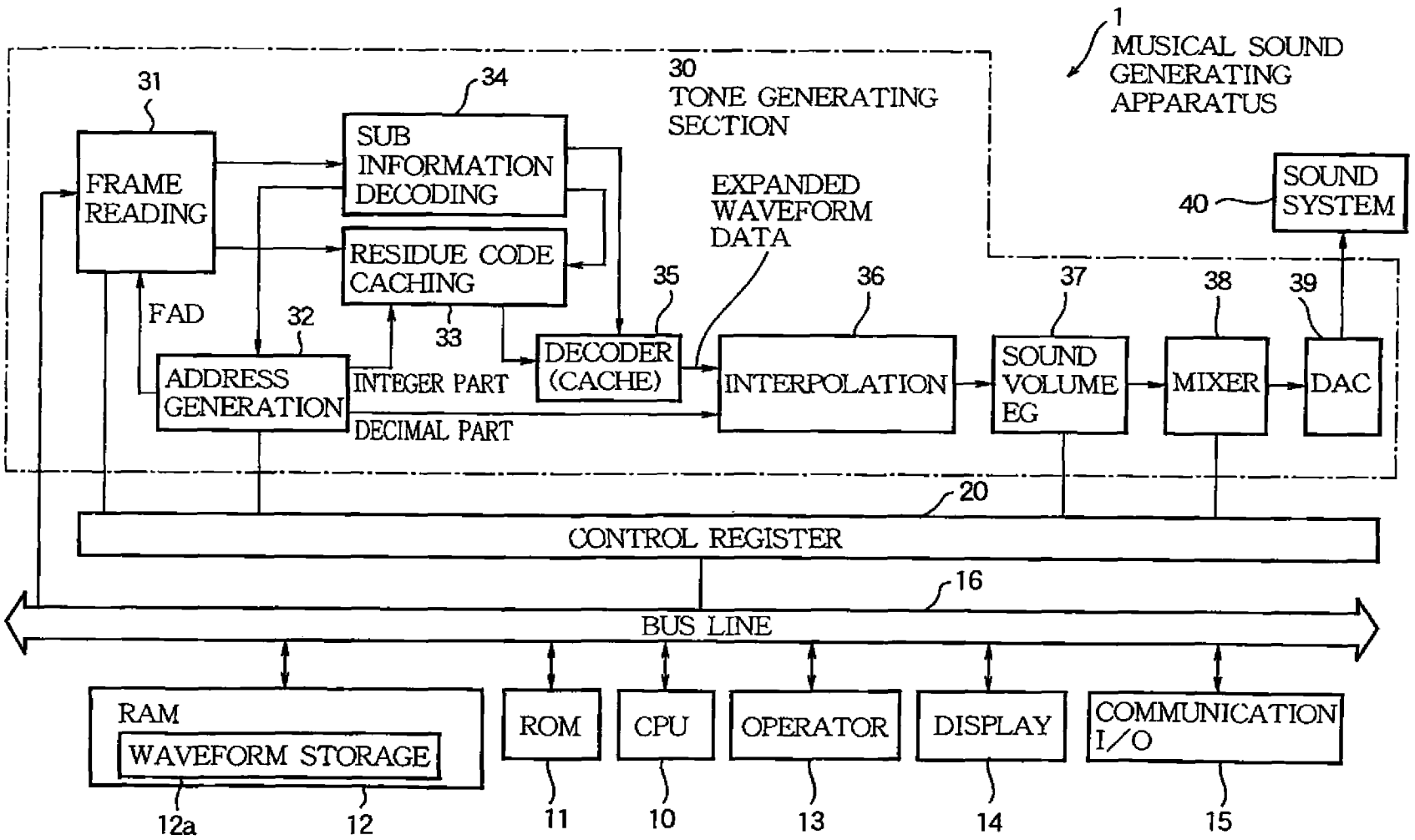
FIG. 1 is a block diagram of a musical sound generating apparatus according to an embodiment of the invention.

Next, FIG. 1 shows a block diagram of a musical sound generating apparatus according to an embodiment of the invention. In a musical sound generating apparatus 1 shown in FIG. 1, CPU 10 is a central processing unit for controlling operation of generating musical sound in the musical sound generating apparatus 1 by executing various programs related to generation of musical sound. That is, when a sounding start instruction (note on) is generated by operating a play operator, or by commencing automatic play, or by an input from a communication I/O or the like, a tone generating section 30 is instructed to start generating musical sound in accordance with the sounding start instruction. ROM (read only memory) 11 is constituted by, for example, flash ROM and is stored with a program of a musical sound generating process executed by CPU 10 and various data. RAM (random access memory) 12 is a main memory of the musical sound generating apparatus 1 and has a rewritable storing section including a waveform storing region 12*a* stored with a compressed data (waveform data compressed in a unit of a frame by a waveform compressing apparatus according to the invention) and a region of a work area of CPU 10 or the like. Further, the waveform storing region 12*a* can be stored with a plurality of tones (timbres) of compressed data.

Further, an operator 13 is a play operator of a keyboard or the like or a panel switch for executing various settings, and a display 14 is a display comprising a liquid crystal or the like for displaying various information in generating musical sound. A communication I/O 15 is a network interface for connecting to a server computer by way of a communication network of LAN (local area network), the internet, a telephone network or the like. MIDI message formed inside of the musical sound generating apparatus 1 can be transmitted to outside, and MIDI message from outside can be received by way of the communication I/O 15. A control register 20 is a register written with sounding parameters of each sounding channel from CPU 10. The tone generating section 30 includes a decoder for carrying out a processing of expanding a compressed data by a unit of a frame, and reads the compressed data for each small frame (described later) necessary for generating musical sound from the waveform storing region 12*a* of RAM 12 based on the control of CPU 10, and carries out the processing of expanding the read compressed data. The tone generating section 30 carries out processing of interpolation, applying of an envelope, accumulating of channels (mixing) and applying of an acoustic effect of the recorded waveform data for output as musical sound waveform data. A musical sound waveform data outputted from the tone generating section 30 is converted into an analog signal and is emitted from a sound system 40. Further, respective sections are connected by way of a bus line 16.

1.2. Data Structure

Figure 2:
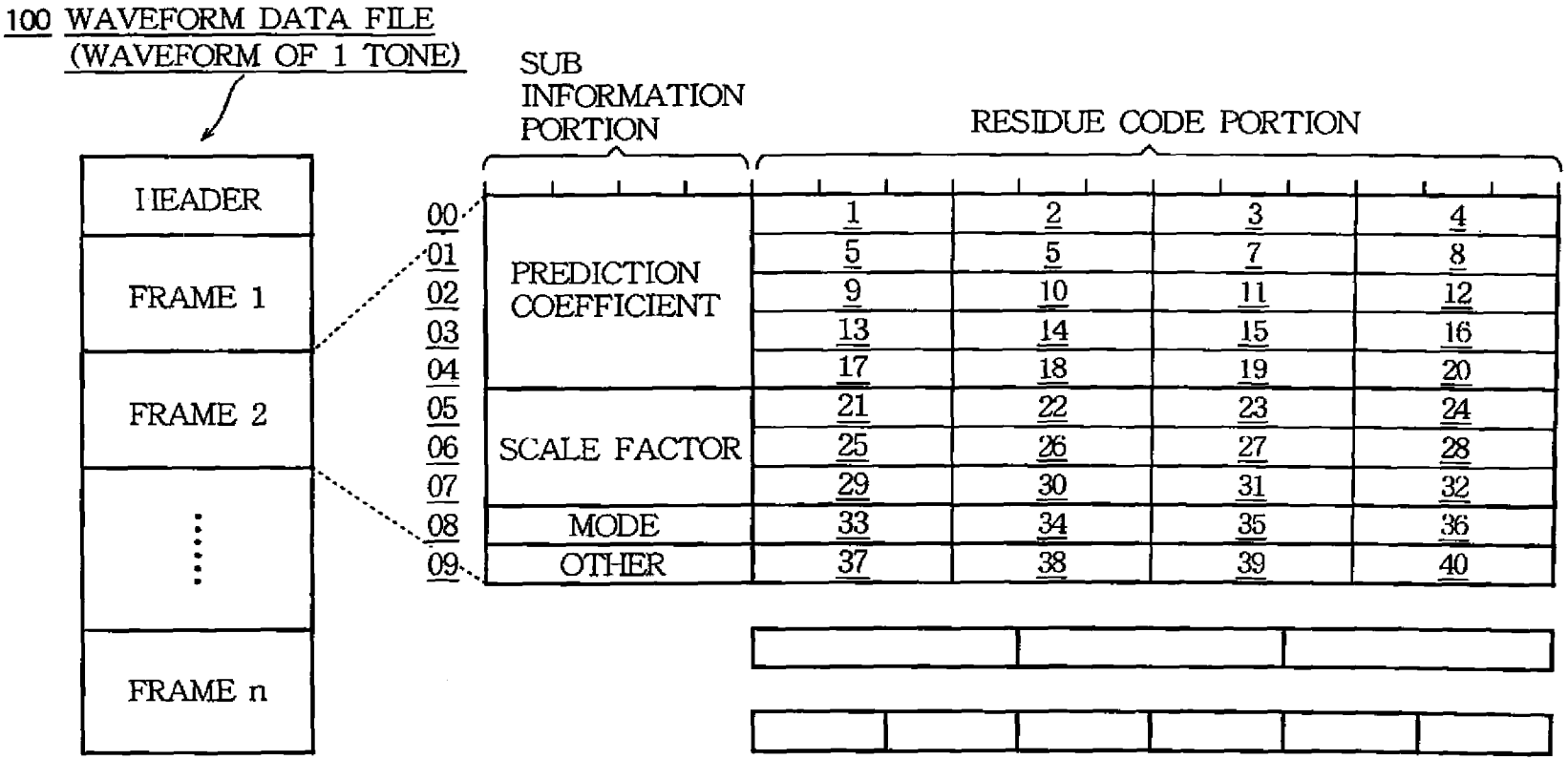
FIG. 2 is a diagram showing a data structure of a waveform data file adopted in the embodiment.

Next, before explaining details of the tone generating section 30, an explanation will be given of a data structure of the compressed data stored in the waveform storing region 12*a* of RAM 12 in reference to FIG. 2. FIG. 2 shows the data amount of one tone of the compressed data stored in the waveform storing region 12*a*. The compressed data shown in FIG. 2 is constituted by a header written with information regarding features or attributes of the compressed data, and a set of frame 1 through frame n each containing a residue code or the like. The header information comprises a bit number of a sample of a residue code, a read start address, a read finish address, a loop address, a prediction coefficient of a first frame, a scale factor and a mode and other data.

Next, an explanation will be given of a data structure of each frame written with a sample of a residue code or the like. First, a data structure of "frame 2" is shown in FIG. 2 as an example. As illustrated, one frame is constituted by ten small frames which correspond to ten addresses from "00" to "09". The small frame is constituted by a sub information portion and a residue code portion.

A data width of one small frame comprises "16" bits as shown by FIG. 2. Among them, a bit number of the sub information comprises "4" bits, a bit number of the residue code portion comprises "12" bits. The residue code portion comprises one or a plurality of residue codes and a bit number of one residue code is set to a fixed bit number determined for each frame suitably for a property of original waveform data before being compressed. However, the bit number of the residue code differs for each frame. First, in an illustrated example of "frame 2", a bit number of one residue code is "3" bits as illustrated, and a number of residue codes per one small frame is "4". Further, if the bit number of one residue code is fixed to "4" bits, as shown by a lower stage of the residue code portion of FIG. 2, a sample number of one small frame becomes "3". Similarly, when the bit number of the one residue code is set to "2" bits, as shown by a lower stage of the residue code portion of FIG. 2, the number of residue codes of one small frame becomes "6". In a total of one frame, since the data width of the small frame is "16", bits, a bit number constituting one frame becomes "160" bits, a data region of "40" bits thereamong constitutes a portion of the sub information, and a data region of remaining "120" bits becomes a portion of the residue code.

Meanwhile, the sub information included in one frame comprises a parameter for decoding a residue code of next frame subsequent to the instant frame. For example, the sub information of "frame 2" comprises a parameter for decoding a residue code of "frame 3". This is caused by a fact that when the waveform data is reproduced, the compressed data is read by a unit of a small frame. That is, when "frame 2" is finished reproduction and a small frame at a top of "frame 3" is read, a parameter for decoding the residue signal at inside of the top small frame has already been found from previous "frame 2", and therefore, the residue code of the top small frame can immediately be decoded.

Next, details of the sub information will be explained.

(1) Prediction coefficient portion: according to the embodiment, in order to specify a value of a certain sample (referred to as target sample), a predicted value of the target sample is calculated by an approximate polynomial from a plurality of past sample values (for example, "4" samples) and a residue (a difference) of an actual value relative to the predicted value is recorded as the residue code of the sample. The prediction coefficient is a coefficient used in the approximate polynomial.

(2) Mode portion: this is information specifying a quantizing system (scalar or vector) adopted for generating of each residue code in the residue code portion and a bit number of each of residue code. There are modes of, for example, "scalar quantization: 2 bits", "scalar quantization: 3 bits", "vector quantization (two-dimensional): 4 bits", "scalar quantization: 4 bits", "vector quantization (two-dimensional): 6 bits", "vector quantization (three-dimensional): 6 bits", "scalar quantization: 6 bits" and the like.

(3) Scale factor portion: this is information of specifying a maximum scale of the residue code in the residue code portion. For example, when the mode is "scalar quantization: 2 bits", a value of the residue code is one of "11b", "10b", "01b", "10b" (notation b designates a binary number) and "11b" thereamong is the maximum value. The scale factor indicates an actual residue value in correspondence with the maximum value "11b". In this case, when the scale factor is stored not by an absolute value but by a ratio between frames or a difference in a logarithmic scale, a range of scale information can be efficiently expanded using a limited number of bits. When the scale factor is constituted by a ratio between frames or the difference in the logarithmic scale, in inversely quantizing the residue code, the ratio or the difference is converted into an absolute value to multiply the residue code.

(4) other information portion: the other information portion is recoded with an identification number of a code book or the like. As is well known, the code book is used to correspond the one residue code to the residue values of a plurality of samples in the vector quantizing system, and the identification number of the code book is attached independently for each mode of the quantizing system. For example, when all of bits (4 bits) of the other information portion are allocated to designate the identification number of the code book, a maximum of "16" kinds of code books can be designated, thereby, a maximum of "16" kinds of code books can be designated for each quantizing system.

Although the code book is generally used for the vector quantizing system, according to the embodiment, the code book is also applied to the scalar quantizing system. The code book in the scalar quantizing system is a table or a function for determining a value of one residue from one residue code, and is a table expressing a correspondence relationship between the residue code and the residue value, or a table of a efficient applied to a function expressing a correspondence relationship between the nominal residue code and the actual residue value.

In the above-described quantizing system of "scalar quantization: 2 bits", when the residue code is a maximum value of "11b", its residue value is equal to the scale factor. Further, when the correspondence relationship between the residue code and the residue is linear, the residue code "10b" becomes "⅔" of the scale factor and the residue code "01b" becomes "⅓" of the scale factor. However, the linear correspondence relationship is not necessarily preferable but, for example, there is also a case in which a nonlinear correspondence relationship of a logarithmic scale or the like is preferable, and therefore, an optimum correspondence relationship is selected by designating the code book. Further, the other information portion may be used as sound amount information or information of a loop address or the like of the waveform data other than the identification number of the code book.

1.3. Detailed Constitution of Tone Generating Section 30

Referring back to FIG. 1, a detailed constitution of the tone generating section 30 will be explained. First, an address generating portion 32 includes a sample counter for accumulating frequency information (F number) and a memory counter for generating a read address for reading the compressed data from the waveform storing region 12*a* of RAM 12 for each small frame. The sample counter generates a sample address comprising an integer part and a decimal part by accumulating F number constituting a pitch shift amount of the compressed data in correspondence with a designated tone pitch, and supplies the integer part to a residue code cache portion 33 and supplies a remaining decimal part to an interpolation portion 36. Further, the sample counter outputs a signal comprising "request pulse" each time the integer part of the sample address reaches the sample number of the small frame. Further, "sample number of small frame" is defined by multiplying a number of residue codes per small frame by a number of samples per one residue code. For example, when the mode is "scalar quantization: 3 bits", the sample number of small frame becomes "4×1=4", when the mode is "vector quantization (three-dimensional): 6 bits), the sample number of small frame becomes "2×3=6". At the memory counter of the address generating portion 32, by counting up the memory address by "1" at each time of inputting the request pulse from the sample counter, small frame address FAD for reading the small frame is generated.

The request pulse and the small frame address FAD are supplied from the address generating portion 32 to the frame reading portion 31. Further, the frame reading portion 31 reads data of the small frame indicated by the small frame address FAD at each time of inputting the request pulse. The sub information in the read data of the small frame is supplied to a sub information decoding portion 34, and the read residue code portion of the small frame is supplied to the residue code cache portion 33. Sub information of each small frame supplied from the frame reading portion 31 is successively collected to the sub information decoding portion 34 at a period of one frame and each data of sub information is decoded. Further, in a next frame period subsequent to the instant frame period, the decoded prediction coefficients and the decoded scale factor are supplied to a decoder 35 and data of the mode portion and the other information portion are supplied to the respective blocks of the tone generating section 30.

In the residue code cache portion 33, newest three of small frames in the read small frames are held in a cache. Further, in accordance with the integer part of the sample address fed from the address generating portion 32, samples of residue codes of a number in correspondence with an advancing amount (incremental amount) of the integer part are taken out from the three cached small frames, and the samples of the taken residue codes are fed to the decoder 35. At the decoder (cache) 35, at each time of transmitting the sample of the residue code from the residue code cache portion 33, the sample of the residue code is decoded by linear prediction expanding of "fourth order" to provide restored waveform samples, for example, four samples of the restored waveform samples are reserved in the waveform data cache at inside of the decoder 35.

The expanded and restored waveform data outputted from the decoder 35 is supplied to the interpolation portion 36. In this case, restored waveform samples D1 through D4 of four samples cached to a waveform data cache portion 74 of the decoder 35 are supplied to the interpolation portion 36. Further, the interpolation portion 36 generates an interpolation sample by interpolating the supplied 4 restored waveform samples D1 through D4 by, for example, 4-point method based on the decimal part of the sample address fed from the address generating portion 32. Meanwhile, the control register 20 is stored with a sound volume EG parameter for determining an envelope applied to the interpolation sample at note ON time (detailed thereof will be described later). A sound volume of the interpolation sample outputted from the interpolation portion 36 is controlled based on the sound volume EG parameter at a sound volume EG portion 37, and a result thereof is supplied to a mixer 38. At the mixer 38, the waveform samples at all of sounding channels are accumulated and an acoustic effect is applied as necessary and a result thereof is outputted at respective reproducing timings. An output from the mixer 38 is supplied to a digital-analog converter (DAC) 39 to be converted into an analog signal and is emitted from the sound system 40.

1.4. Detailed Constitution of Decoder 35 (Waveform Decompressing Apparatus)

Figure 3:
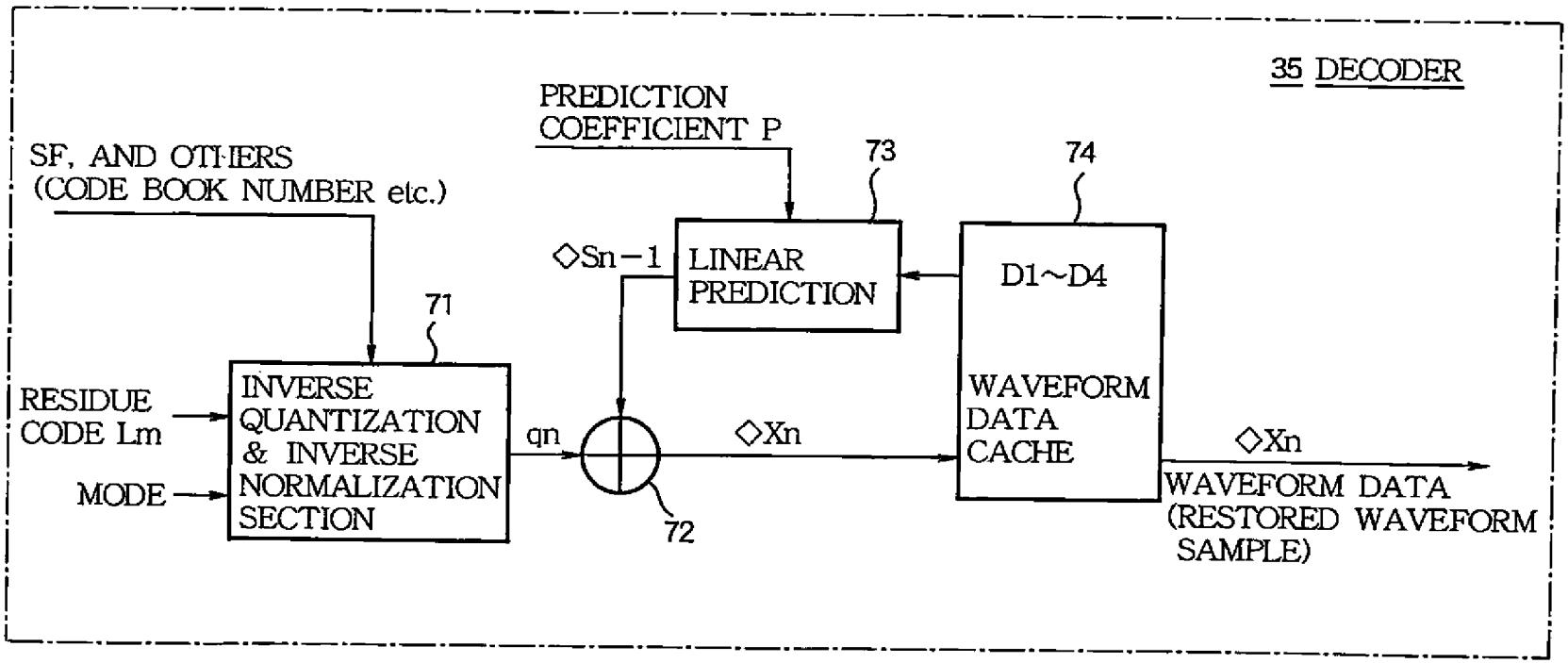
FIGS. 3(*a*) and 3(*b*) illustrate diagrams showing a detailed constitution of a decoder shown in FIG. 1.
Figure 3:
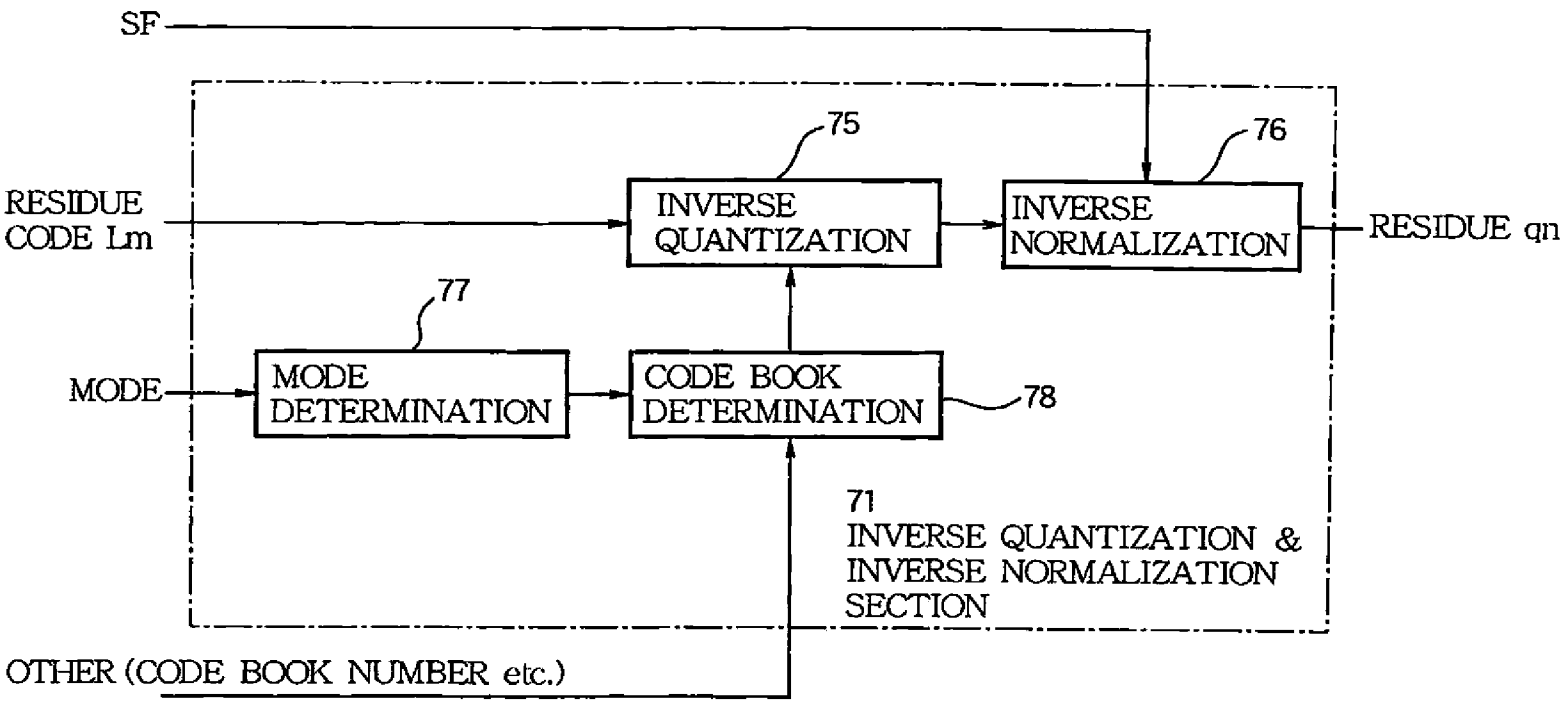

Next, a detailed constitution of the decoder 35 in the tone generating section 30 will be explained with reference to FIG. 3(*a*). The decoder 35 is supplied with the residue code Lm from the residue code cache portion 33 and supplied with various information including the prediction coefficient, the scale factor SF, the mode, the code book number and other information from the sub information decoding portion 34. At inside of the decoder 35, an inverse quantization & inverse normalization section 71 is supplied with the mode, the scale factor SF, the residue code and the code book number, and a residue sample qn of each waveform sample is outputted based thereon. Further, details of the inverse quantization & inverse normalization section 71 will be described later. Meanwhile, a number of the residue samples qn generated based on one residue code Lm is "1" when the scalar quantization method is adopted and a plural number (normally "2" or "3") when the vector quantizing system is adopted.

The residue sample qn is supplied to an adder 72. Further, the adder 72 is supplied with a linear prediction sample $\diamond S_{n-1}$ constituting a predicted value of the target sample fed from a linear prediction operating portion 73. At the adder portion 72, by adding the qn and $\diamond S_{n-1}$ with each other, a restored waveform sample ◇Xn related to the target sample is outputted. The restored waveform sample ◇Xn is cached to a waveform data cache portion 74 and is outputted therefrom as an expanded waveform data.

At the waveform data cache portion 74, "4" samples of restored waveform samples ◇Xn through ◇Xn−3 (D1 through D4) are cached from present to past, and cached "4" samples of restored waveform samples D1 through D4 are supplied to the linear prediction operating portion 73. At the linear prediction operating portion 73, linear prediction of fourth-order is carried out by multiplying the restored waveform samples D1 through D4 by linear prediction coefficients P having respective orders and adding together to generate a linear prediction sample ◇Sn for use in reproducing a next restored waveform sample $\diamond X_{n+}1$.

Next, a detailed constitution of the inverse quantization & inverse normalization section 71 will be explained with reference to FIG. 3(*b*). At a mode determining portion 77, based on the supplied mode, a quantization system (scalar or vector) for a current frame and a bit number of each residual code are specified. Next, at a code book determining portion 78, based on the quantization system, the bit number of the residue code, the code book number included in the other information portion, an adopted code book is determined, and the determined code book is supplied to an inverse quantization portion 75. At the inverse quantization portion 75, based on the code book, one or a plurality of residues are generated from one residue code Lm. Next, at an inverse normalization portion 76, the residues are multiplied by the scale factor SF to thereby output inversely normalized residue sample qn.

In this way, according to the musical sound generating apparatus 1 of the embodiment, at the mode determining portion 77, it is determined which of the scalar quantization method or the vector quantization method is applied to each frame a frame by frame basis, and therefore, mixed compressed data including a frame applied with the scalar quantization method and another frame applied with the vector quantization method can pertinently be restored.

Further, although the compressed data formed by the prior art for the sound source adopts only the scalar quantization method, such compressed data can be reproduced by the musical sound generating apparatus 1 of the embodiment. That is, the musical sound generating apparatus 1 of the embodiment is constituted to be compatible with the conventional musical sound generating apparatus at a higher order, and therefore, a resource of the compressed data which is formed in the past (only adopting a scalar quantization method) can effectively be utilized.

Further, each frame of the compressed data is stored with the residue code necessary for reproducing each frame as well as the sub information for expanding the residue code of next frame, and therefore, in the tone generating section 30, an exclusive circuit for taking out the sub information with an excellent timing is dispensed with, and the circuit constitution can be simplified.

Thus, the waveform decompressing apparatus according to the invention is designed for providing a restored waveform data (◇Xn) by restoring a compressed data having a residue code (Lm) and sub information specifying a mode applied to generation of the residue code (Lm) in each of a plurality of frames of a predetermined format. The waveform decompressing apparatus comprises a mode determining portion (77) for determining whether a vector quantization method is adopted as the mode in the sub information, and an inverse quantization portion (75) for restoring a plurality of waveform samples from the one residue code (Lm) under a condition that a result of affirmative determination is made in the mode determining portion (77), on the other hand, restoring one waveform sample from the one residue code (Lm) under a condition that a result of negative determination is made in the mode determining portion (77).

Further, the waveform decompressing apparatus according to another aspect of the invention is designed for providing a restored waveform data (◇Xn) by restoring a compressed data comprising a residue code (Lm) and sub information specifying a mode applied to generation of the residue code (Lm) in each of a plurality of frames of a predetermined format, wherein the mode is a vector quantization method. The waveform decompressing apparatus comprises a mode specifying portion (35) for specifying the mode by reading the sub information for each frame, and an inverse quantization portion (75) for restoring respective pluralities of waveform samples from the respective residue codes (Lm) included in the respective frames based on the specified mode.

1.5. Operation of Musical Sound Generating Apparatus

Next, operation of the musical sound generating apparatus 1 will be explained.

When sounding start instruction (note ON) is generated by operation of a play operator, or by commencing automatic play, or by an input from the communication I/O 15 or the like, CPU 10 instructs to start generating of musical sound in accordance with the sounding start instruction to the tone generating section 30. Here, note ON includes designation of part (tone) PT, sound pitch N, intensity or volume V. A process in this case is as follows.

(1) First, one of a plurality of sounding channels of the tone generating section 30 is allocated to generation of the musical sound.

(2) Based on tone data (on RAM 12) currently selected by part PT, one of waveform data stored in the waveform storing region 12*a* is selected and a pitch shift amount, a sound volume EG parameter, an LFO parameter, an output level or the like is set to the allocated sounding channel region of the control register 20.

(3) The header of the selected waveform data is read, and the bit number of the residue code, the read start address, the read finish address, the loop address, and the prediction coefficient, the scale factor, the mode used for the data compression, and the other data of the first frame are set to the sounding channel region. Each address in this case may be an address corresponding to a frame.

(4) The instruction of note ON is written to the sounding channel region.

Thereby, the musical sound is started to generate (waveform is started to be expanded) at the tone generating section 30.

2. Waveform Compressing Apparatus

2.1. Constitution of Waveform Compressing Apparatus

Figure 4:
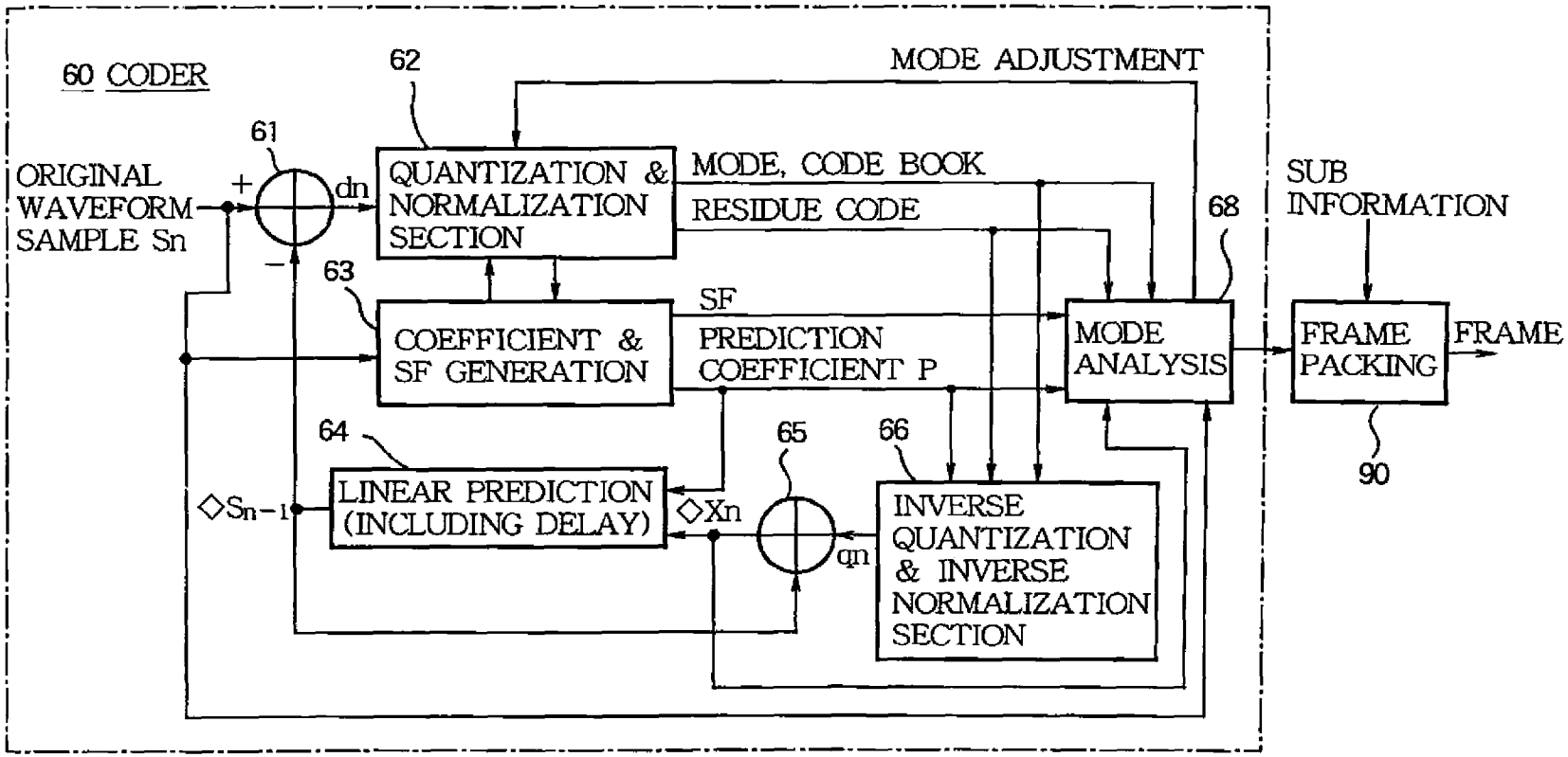
FIGS. 4(*a*) and 4(*b*) illustrate block diagrams of an algorism performed in the embodiment of a waveform compressing apparatus of the invention.
Figure 4:
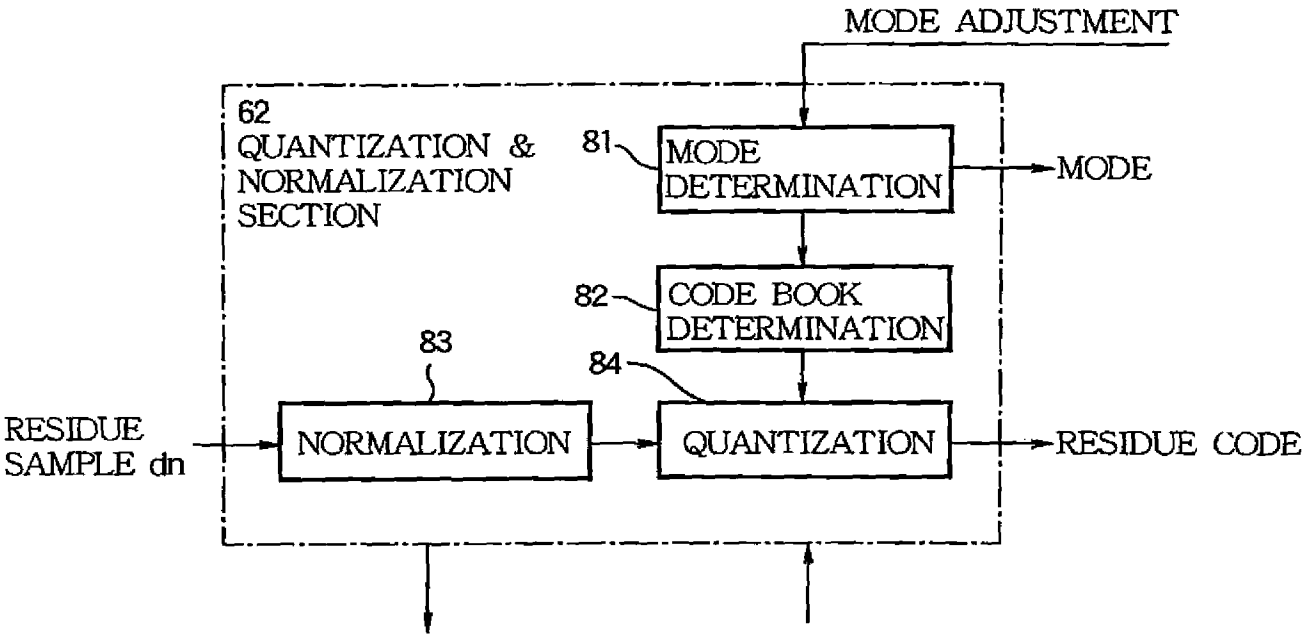

Next, an explanation will be given of an embodiment of the waveform compressing apparatus for generating the compressed waveform data (FIG. 2) by utilizing linear prediction. The constitution of hardware of the waveform compressing apparatus is similar to the musical sound generating apparatus 1 (FIG. 1). The waveform compressing process is executed by a program operated on CPU 10. An algorism constitution of the program is shown in FIGS. 4(*a*) and 4(*b*). However, a total or a portion of the algorism constitution may be realized by a hardware. According to the embodiment, the waveform storing region 12*a* at inside of RAM 12 is stored with the original waveform data which is not compressed, and also compressed data constituting a result of compressing the original waveform data is also stored to the waveform storing region 12*a*.

In the embodiment, a plurality of modes having a possibility of being applied to the compressing process are referred to as "candidate modes", and one mode selected from the candidate modes for a trial of the compressing process is referred to as "trial mode". A priority order selected as the trial mode is determined for each candidate mode, and a list arranging the candidate modes in accordance with the priority order is referred to as "mode list". Here, the priority for the mode list is determined as follows. First, a candidate mode having a high compression rate is set with the priority higher than another candidate mode having a low compression rate. Further, with regard to a plurality of candidate modes having an equal compression rate, the priority is set to be higher for the vector quantization method than the scalar quantization method. Further, among the vector quantization methods, a priority of a mode having a higher order of dimensions is set to be high.

This is because between the candidate modes having the equal compression rate, a possibility of restraining S/N ratio to be low is higher in the compression data provided by the vector quantization method. For example, the bit number of the residue code per one sample in the original waveform data is "2" in all of "scalar quantization: 2 bits" mode, "vector quantization (two-dimensional): 4 bits" mode, and "vector quantization (three-dimensional): 6 bits" mode, and therefore, the compression rate stays to be equal. In such a case, the priority is determined in the order of "vector quantization (three-dimensional): 6 bits" mode, "vector quantization (two-dimensional): 4 bits" mode, "scalar quantization: 2 bits" mode.

In FIG. 4(*a*), a quantization & normalization section 62 is stored with the mode list, and one candidate mode is selected as "trial mode" for carrying out the compressing process in accordance with the order of the mode list. Further, the quantization & normalization section 62 is also stored with the code book used in the vector quantization method and the scalar quantization method. At the quantization & normalization section 62, first, a top candidate mode in the mode list is selected as the trial mode. When the trial mode is determined, the number of the residue codes is specified, and therefore, the sample number K of the sample of the original waveform data (hereinafter, referred to as "original waveform sample") Sn in correspondence with one frame is specified. When the sample number K is specified, the original waveform sample is read from a top of an uncompressed section of the original waveform data by the sample number K, and is supplied to a prediction coefficient & scale factor generating portion 63.

At the prediction coefficient & scale factor generating portion 63, the original waveform sample Sn of the sample number K is analyzed, and the prediction coefficient P and the scale factor SF is determined. On the other hand, at a subtractor 61, one sample of the original waveform sample Sn of the sample number K is supplied a sample by sample basis. Further, the subtractor 61 is supplied with one sample of a linear prediction sample ◇Sn−1 mentioned later a sample by sample basis. Thereby, the residue sample dn (=Sn−◇Sn−1) is outputted from the subtractor 61. Further, although in the specification, signs of "dn" and "qn" are used for the residue sample, "dn" is provided by subtracting the linear prediction sample ◇Sn−1 from the original waveform sample Sn as described above, and "qn" is provided by subjecting the residue code to inverse quantization and inverse normalization.

At the quantization & normalization section 62, the residue sample dn is converted into the residue code based on the trial mode, the scale factor SF and the code book. That is, first, the residue sample dn is normalized by being divided by the scale factor SF. Further, a detailed constitution of the quantization & normalization section 62 will be described later. An inverse quantization & inverse normalization section 66 is supplied with the scale factor SF, the trial mode, the code book number, the residue code. The inverse quantization & inverse normalization section 66 is constituted similar to the inverse quantization & inverse normalization section 71 mentioned before (FIG. 3(*b*)) and the residue sample qn subjected to the inverse normalization is outputted therefrom.

At an adder 65, the residue sample qn, and the linear prediction sample ◇Sn−1 are added, and a result of addition is outputted as a restored waveform sample ◇Xn. The linear prediction portion 64 is constituted similar to the linear prediction operation portion 73 and the waveform data cache portion 74 (FIG. 3(*a*). That is, the linear prediction portion 64 receives the linear prediction coefficient P from the prediction coefficient & scale factor generating portion 63, caches past "4" samples of restored waveform samples ◇Xn through ◇Xn−3, multiplies the restored waveform samples D1 through D4 by the linear prediction coefficients P of respective orders, and adds together to output the linear prediction sample ◇Sn for use in generating a next restored waveform sample ◇Xn+1.

A mode analyzing portion 68 is supplied with the original waveform sample Sn and the restored waveform sample ◇Xn to measure an evaluation value of a quantization error (S/N ratio) included in the restored waveform sample ◇Xn related to one frame. Further, when the evaluation value exceeds a predetermined allowable value, a mode change instruction is outputted from the mode analyzing portion 68 to the quantization & normalization section 62. At the quantization & normalization section 62, when the mode change instruction is supplied, a next candidate mode in the mode list is selected as the trial mode. When a new trial mode is selected, at the prediction coefficient & scale factor generating portion 63, a new sample number K is determined, a residue code under a new trial mode is generated similar to the above-described operation, the restored waveform sample ◇Xn is generated, and an evaluation value of a quantization error (S/N ratio) included in the restored waveform sample ◇Xn is measured again. Further, a similar operation is repeated until the evaluation value becomes equal to or smaller than the allowable value.

Further, when the evaluation value of the quantization error of the restored waveform sample ◇Xn supplied to the mode analyzing portion 68 does not exceed the allowable value, a frame constructing instruction is outputted from the mode analyzing portion 68 to a frame packing section 90. The frame packing section 90 receives the prediction coefficient and the scale factor SF from the prediction coefficient & scale factor generating portion 63 and receives the identification of the trail mode, the code book number and the residue code from the quantization & normalization section 62, and crams received information into "160" bits, thereby, generates the frame comprising ten small frames (FIG. 2). Thereby, the trial mode finally selected to the instant frame is adopted as a practical mode which is finally applied.

Next, a detailed constitution of the quantization & normalization section 62 will be explained with reference to FIG. 4(*b*). First, at a normalization portion 83, the residue sample qn is divided by the scale factor SF, and the residue sample normalized thereby is outputted. At a mode determining portion 81, first, a top candidate mode in the mode list is adopted as a trial mode, thereafter, a next candidate mode in the mode list is selected as a trial mode when the mode change instruction is supplied from the mode analyzing portion 68. At the code book determining portion 82, based on a state of distribution of the residue samples qn, an optimum one of maximum "16" kinds of existing code books is selected.

At a quantization portion 84, when the trial mode is constituted by the scalar quantization method, the normalized residue sample is formed in correspondence with the residue code in accordance with a characteristic based on the code book (linear or nonlinear characteristic) in a one-to-one relationship. That is, scaling is carried out for the bit number related to the trial mode and the residue code Lm is generated. On the other hand, when the trial mode is constituted by the vector quantization method, the normalized residue sample is converted into the residue code Lm based on the code book at each predetermined number ("2" or "3").

2.2. Operation of Essential Portion of Waveform Compressing Apparatus

Figure 5:
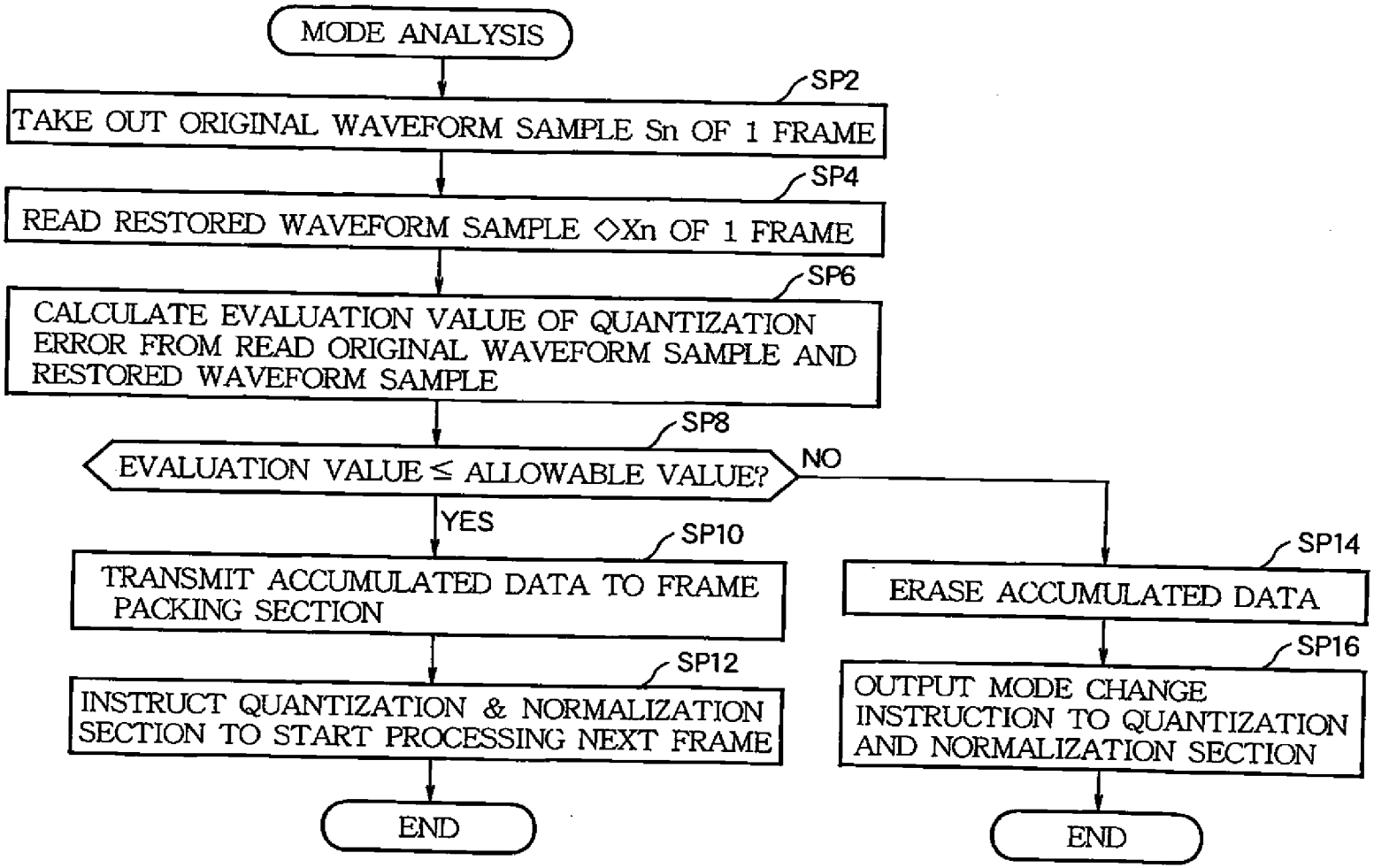
FIG. 5 is a flowchart of a mode analyzing process performed in the waveform compressing apparatus of the invention.

Next, an explanation will be given of a content of a processing executed when a trial mode is designated by instructing to read a new frame or by outputting a mode change instruction at the mode analyzing portion 68 in the above-described waveform compressing apparatus with reference to FIG. 5. In FIG. 5, when the processing proceeds to step SP2, a sample of waveform data (original waveform sample) selected from the waveform storing region 12*a* is taken out by the sample number K in correspondence with one frame, and is supplied to a coder 60. At the coder 60, the residue code Lm in accordance with the trial mode is outputted from the quantization & normalization section 62, and based on the residue code Lm, the restored waveform sample ◇Xn is outputted by way of the inverse quantization & inverse normalization section 66 and the adder 65. The restored waveform sample ◇Xn of an amount of one frame is stored to a predetermined region at inside of RAM 12.

When the restored waveform sample ◇Xn of the amount of one frame has been finished to store, the processing proceeds to step SP4 to read the restored waveform sample ◇Xn of one frame from RAM 12. Next, when the processing proceeds to step SP6, the original waveform sample Sn and the restored waveform sample ◇Xn each stored at inside of RAM 12 in correspondence with one frame are compared with each other for analysis, and the evaluation value (S/N ratio) of the quantization error included in the restored waveform sample ◇Xn is measured.

Next, when the processing proceeds to step SP8, it is determined whether the evaluation value is equal to or smaller than the predetermined allowable value. When it is determined to be "NO" in the step, the processing proceeds to step SP14 and the residue code Lm accumulated at inside of the mode analyzing portion 68 is erased. Next, when the processing proceeds to step SP16, the mode change instruction is outputted from the mode analyzing portion 68 to the quantization & normalization section 62. Although the processing of the routine is finished by the above-described steps, thereafter, when a next candidate mode of the mode list is selected as a new trial mode at the quantization & normalization section 62, the above-described processing of steps SP2 through SP8 is repeated again.

Further, when the evaluation value of the quantization error becomes equal to or smaller than the allowable value, it is determined to be "YES" at step SP8, and the processing proceeds to step SP10. At step SP10, the residue code Lm accumulated at inside of the mode analyzing portion 68 is transmitted to the frame packing section 90, thereby, the frame is formed at inside of the frame packing section 90. Next, when the processing proceeds to step SP12, a processing of a next frame is instructed to start to the quantization & normalization section 62. Thereby, a processing similar to the above-described processing is repeated for the next frame.

In the following, when the new frame is instructed to read, or at each time of designating a new trail mode, the mode analyzing routine (FIG. 5) is executed, finally, the frame is constituted for all of the original waveform samples Sn. When all the frames are constituted, the header is provided to the frames and the data compression is finished. The finished compressed data is written to the ROM or the like and the ROM is used as ROM 11 or the like of the above-described musical sound generating apparatus 1.

Thus, the waveform compressing apparatus according to one aspect of the invention is designed for converting an original waveform data (Sn) into a compressed data having a residue code (Lm) and sub information specifying a mode applied to generation of the residue code (Lm) in each of a plurality of frames of a predetermined format. The waveform compressing apparatus comprises a trial mode determining portion (81) for selecting a candidate mode having the highest compression rate as the trial mode from the plurality of candidate modes for providing the residue code (Lm), a waveform data compressing portion (84) for compressing a data amount in correspondence with the trial mode in the original waveform data in accordance with the determined trial mode, and generating the residue code (Lm) in correspondence with the trial mode, a waveform data restoring portion (66) for generating a restored waveform data (◇Xn) by restoring the residue code (Lm), a determining portion (68, SP8) for measuring an evaluation value (S/N ratio) of a quantization error provided to the restored waveform data (◇Xn) relative to the original waveform data (Sn) and determining whether the evaluation value is equal to or smaller than a predetermined allowable value, a mode change instructing portion (68, SP16) for outputting a mode change instruction of selecting a new trial mode to the trial mode determining portion (81) under a condition that a result of negative determination is made in the determining portion (68, SP8), and a frame storing portion (90) for storing the residue code and the sub information specifying the trail mode to the frame under a condition that a result of affirmative determination is made in the determining portion (68, SP8).

Further, in the waveform compressing apparatus described above, at least a portion of the plurality of candidate modes is a mode of a vector quantization method.

Further, in the waveform compressing apparatus described above, the plurality of candidate modes include a plurality of modes adopting a scalar quantization method and a plurality of modes adopting a vector quantization method, and the plurality of modes adopting the scalar quantization method and the plurality of modes adopting the vector quantization method comprise pluralities of modes having different bit numbers per respective one residue code (Lm).

Further, another waveform compressing apparatus according to another aspect of the invention is provided for converting an original waveform data (Sn) into a compressed data having a residue code (Lm), and sub information specifying a mode applied to generation of the residue code (Lm) in each of a plurality of frames of a predetermined format. The waveform compressing apparatus comprises a mode determining portion (81) for selecting one mode applied to generation of the residue code (Lm) from a plurality of candidate modes of a vector quantization method, a waveform data compressing portion (84) for compressing a data amount in correspondence with the one mode in the original waveform data in accordance with the selected one mode and generating the residue code (Lm) in correspondence with the one mode, and a frame storing portion (90) for storing the residue code and the sub information specifying the one mode in the frame.

Further, the waveform compressing apparatus comprises a code book determining portion (82) for selecting one code book from a plurality of code books in correspondence with the one mode, wherein the waveform data compressing portion (84) compresses a data amount in correspondence with the one mode in the original waveform data in accordance with the selected one mode and the selected one code book and generating the residue code (Lm) in correspondence with the one mode, and the sub information further includes information for specifying the one code book.

As explained above, according to the invention, the trial mode is successively selected from the mode list mixed with the scalar quantization modes and the vector quantization modes, When the evaluation value of the quantization error related to the residue code provided by the trial mode becomes equal to or smaller than the allowable value, the trial mode becomes the practical mode which is finally applied. Therefore, the optimum quantization system can be selected for each frame from the scalar quantization method and the vector quantization method, and the total data amount of the compressed data can effectively be reduced.

3. Modified Example

The invention is not limited to the above-described embodiment but can variously be modified as, for example, follows.

(1) Although in the above-described embodiment of the waveform compressing apparatus, the waveform compressing process is carried out by the program operated on the musical sound generating apparatus 1, only the program may be stored to a record medium of CD-ROM, a memory card or the like to distribute, or may be distributed by way of a communication network path.

(2) Although in the above-described embodiment of the waveform compressing apparatus, the vector quantizing system is set to have a priority higher than the scalar quantization method for a plurality of candidate modes having an equal compression rate in the mode list. However, depending on kinds of musical tone, namely kinds of musical instruments, there is also a conceivable case in which a possibility of restraining the S/N ratio to be low is higher in the scalar quantization method. In such a case, the priority may be set to be higher for the scalar quantization method than the vector quantization method among a plurality of candidate modes having an equal compression rate.

The invention is characterized in providing a machine readable medium containing a computer program shown below in order to resolve the drawbacks of the prior art. Inside of a parenthesis is an exemplification.

A computer program according to the invention is a program for converting an original waveform data (Sn) into a compressed data having a residue code (Lm) and sub information specifying a mode applied to generation of the residue code (Lm) and having a plurality of frames of a predetermined format. The program makes a processing apparatus (10) execute a trial mode determining process (81) of selecting one candidate mode as the trial mode in a plurality of the candidate modes for providing the residue code (Lm), a waveform data compressing process (84) of compressing a data amount in correspondence with the trial mode in the original waveform data in accordance with the determined trial mode and generating the residue code (Lm) in correspondence with the trial mode, a waveform data restoring process (66) of generating a restored waveform data (◇Xn) by restoring the residue code (Lm), a determining process (68, SP8) of measuring an evaluation value (S/N ratio) of a quantization error provided to the restored waveform data (◇Xn) relative to the original waveform data (Sn) and determining whether the evaluation value is equal to or smaller than a predetermined allowable value, a mode change instructing process (68, SP16) of outputting a mode change instruction for selecting a new trial mode to the trial mode determining process (81) under a condition that a result of negative determination is made in the determining process (68, SP8), and a frame storing process (90) of storing the residue code and the sub information specifying the trial mode in the frame under a condition that a result of negative determination is made in the determining process (68, SP8).

Further, another computer program according to the invention is a program for converting an original waveform data (Sn) into a compressed data having a residue code (Lm) and sub information specifying a mode applied to generation of the residue code (Lm) and having a plurality of frames of a predetermined format. The program makes a processing apparatus (10) execute a mode determining process (81) of selecting one mode applied to generation of the residue code (Lm) from a plurality of candidate modes of a vector quantization method, a waveform data compressing process (84) of compressing a data amount in correspondence with the one mode in the original waveform data in accordance with the selected one mode and generating the residue code (Lm) in correspondence with the one mode, and a frame storing process (90) of storing the residue code and the sub information specifying the one mode in the frame.

The invention claimed is:

1. A waveform compressing apparatus for converting data of an original waveform signal into a compressed data with a given compression rate, the compressed data having a plurality of frames of a predetermined format, the waveform compressing apparatus comprising:

a trial mode selecting device that selects a trial mode having the highest compression rate from a plurality of candidate modes that have not been previously selected as a trial mode for generating a residue code, the selected trial mode comprising a scalar quantization mode or a vector quantization mode;

a compressing device that compresses the sample data of the original waveform signal according to the selected trial mode so as to generate the residue code corresponding to the selected trial mode, an amount of the sample data of the original waveform signal to be compressed being specified by the selected trial mode;

a waveform signal generating device that generates a sample data of a restored waveform signal using the generated residue code and the selected trial mode;

a determining device that determines an evaluation value that indicates a quantization error contained in the sample data of the restored waveform signal by comparing the sample data of the restored waveform signal relative to the sample data of the original waveform signal, and that determines whether the evaluation value is equal to or smaller than a predetermined allowable value;

a mode change instructing device that outputs a mode change instruction for instructing the trial mode selecting device to select another trial mode when the determining device determines that the evaluation value is not equal to or smaller than the predetermined allowable value; and a frame storing device that stores the generated residue code and sub information specifying the selected trial mode as the compressed data corresponding to the sample data of the original waveform signal in a frame corresponding to the sample data of the original waveform signal when the determining device determines that the evaluation value is equal to or smaller than the predetermined allowable value, the compressed data being stored for use in generation of a timbre of a musical tone.

2. The waveform compressing apparatus according to claim 1, wherein the plurality of the candidate modes include a vector quantization mode using a vector quantization method for generating the residue code.

3. The waveform compressing apparatus according to claim 2, wherein the plurality of the candidate modes include a group of scalar quantization modes using a scalar quantization method for generating the residue code and another group of vector quantization modes using a vector quantization method for generating the residue code, the respective scalar vector quantization modes generating the corresponding residue codes composed of bit numbers that are different from each other, and the respective vector quantization modes generating the corresponding residue codes composed of bit numbers that are different from each other.

4. The waveform compressing apparatus according to claim 1, further comprising:

a prediction coefficient generating device that generates a linear prediction coefficient by analyzing a sample of the original waveform data; and a linear predicting device that generates a linear prediction sample using the linear prediction coefficient, wherein the waveform data generating device generates a residue sample using the generated residue code and the selected trial mode, and generates a sample of a restored waveform data based on the generated residue sample and the linear prediction sample.

5. The waveform compressing apparatus according to claim 4, wherein the frame storing device stores the sub information further containing the linear prediction coefficient.

6. The waveform compressing apparatus according to claim 4, wherein the prediction coefficient generating device further generates a scale factor by analyzing the sample of the original waveform data.

7. The waveform compressing apparatus according to claim 1, wherein the trial mode selecting device selects the trial mode from the plurality of candidate modes according to priorities set to the respective candidate modes, the candidate modes including a vector quantization mode using a vector quantization method adapted to generate the residue code and a scalar quantization mode using a scalar quantization method adapted to generate the residue code, the vector quantization mode having a compression rate equal to a compression rate of the scalar quantization mode and being set with a priority higher than the scalar quantization mode.

8. The waveform compressing apparatus according to claim 1, wherein the trial mode selecting device selects the trial mode from the plurality of candidate modes according to priorities set to the respective candidate modes, the candidate modes including a plurality of vector quantization modes of different numbers of dimension using a vector quantization method adapted to generate the residue code, a vector quantization mode having a number of dimension higher than other vector quantization method being set with a priority higher than the other vector quantization mode.

9. A waveform decompressing apparatus for providing a restored waveform signal composed of a sequence of sample data by decompressing a compressed data being converted by the waveform compression apparatus according to claim 1 and having a plurality of frames of a predetermined format, the waveform decompressing apparatus comprising:

a mode determining device that determines whether the mode specified by the sub information is a vector quantization mode that uses a vector quantization method for generating a residue code; and an inverse quantization device that restores a plurality of sample data from one residue code contained in the frame when the mode determining device determines that the mode specified by the sub information is the vector quantization mode, and otherwise restores one sample data from one residue code contained in the frame when the mode determining device determines that the mode specified by the sub information is not the vector quantization mode.

10. A method of producing a compressed data with a given compression rate based on a sample data of an original waveform signal the compressed data having a plurality of frames of a predetermined format, the method comprising:

a trial mode selecting process of selecting a trial mode having the highest compression rate from a plurality of candidate modes that have not been previously selected as a trial mode for generating a residue code, the selected trial mode comprising a scalar quantization mode or a vector quantization mode;

a compressing process of compressing the sample data of the original waveform signal according to the selected trial mode so as to generate the residue code corresponding to the selected trial mode, an amount of the sample data of the original waveform signal to be compressed being specified by the selected trial mode;

a waveform signal generating process of generating a sample data of a restored waveform signal using the generated residue code and the selected trial mode;

a determining process of determining an evaluation value that indicates a quantization error contained in the sample data of the restored waveform signal by comparing the sample data of the restored waveform signal relative to the sample data of the original waveform signal, and determining whether the evaluation value is equal to or smaller than a predetermined allowable value;

a mode change instructing process of outputting a mode change instruction for instructing the trial mode selecting process to select another trial mode when the determining process determines that the evaluation value is not equal to or smaller than the predetermined allowable value; and a frame storing process of storing the generated residue code and sub information specifying the selected trial mode as the compressed data corresponding to the sample data of the original waveform signal in a frame corresponding to the sample data of the original waveform signal when the determining process determines that the evaluation value is equal to or smaller than the predetermined allowable value, the compressed data being stored for use in generation of a timbre of a musical tone.

* * * * *